US006434832B1

(12) United States Patent
Garrett

(10) Patent No.: US 6,434,832 B1
(45) Date of Patent: Aug. 20, 2002

(54) HAIR-CUTTING TOOL

(76) Inventor: Ashley B. Garrett, 4415 Ashcroft Ct., Gloucester Ontario (CA), K1J 1C7

( * ) Notice: Subject to any disclaimer, the term of this patent is extended or adjusted under 35 U.S.C. 154(b) by 0 days.

(21) Appl. No.: 09/711,525

(22) Filed: Nov. 14, 2000

(51) Int. Cl.[7] ..... B26B 13/04

(52) U.S. Cl. ..... 30/226; 30/254; 30/260; 30/341

(58) Field of Search ..... 30/254, 255, 256, 30/257, 258, 260, 194, 226, 341; D08/57

(56) References Cited

U.S. PATENT DOCUMENTS

| | | | | | |
|---|---|---|---|---|---|
| 550,483 | A | * | 11/1895 | Carrier | 30/226 |
| 953,070 | A | * | 3/1910 | Thompson | 30/226 |
| 2,639,504 | A | * | 5/1953 | May | 30/260 |
| 2,640,264 | A | * | 6/1953 | Sullivan et al. | 30/341 |
| 2,737,718 | A | * | 3/1956 | Maunu | 30/260 |
| 2,840,905 | A | * | 7/1958 | Geiger | 30/226 |
| 3,052,026 | A | * | 9/1962 | Muller | 30/260 |
| 3,831,277 | A | * | 8/1974 | Nagata | 30/195 |
| 3,906,630 | A | * | 9/1975 | Megna | 30/260 |
| D267,996 | S | * | 2/1983 | Kowalski | 30/226 |
| 5,109,608 | A | * | 5/1992 | Pracht | 30/254 |
| 5,600,891 | A | * | 2/1997 | Orgal | 30/226 |
| 5,722,171 | A | * | 3/1998 | Schmidt | 30/255 |
| 5,875,553 | A | * | 3/1999 | Geib, Jr. et al. | 30/226 |
| 5,964,038 | A | * | 10/1999 | DeVito | 30/226 |
| 5,996,592 | A | * | 12/1999 | Choy | 132/200 |

* cited by examiner

*Primary Examiner*—Hwei-Slu Payer
(74) *Attorney, Agent, or Firm*—Robert G. Hendry; Robert A. Wilkes

(57) ABSTRACT

A manually operable hair-cutting tool is disclosed wherein a plurality of paired cutting blades operate together simultaneously to achieve cutting or thinning of hair. The hair-cutting tool preferably comprises three pairs of elongated cutting blades, the pairs separate from each other but provided with an element of being connected together at a pivot point and thereby forming a combination of a central pair of cutting blades and two outer pairs of cutting blades, such that the cutting blades operate together through movement of actuating handles on the central pair of cutting blades around the pivot point. The outer pairs of cutting blades can optionally be removed for operation of the hair-cutting tool as a traditional pair of scissors and for ease of sharpening.

3 Claims, 3 Drawing Sheets

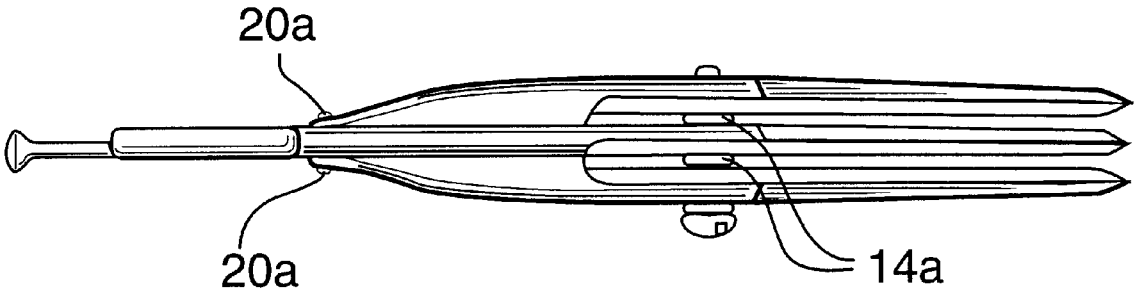
FIG. 2a
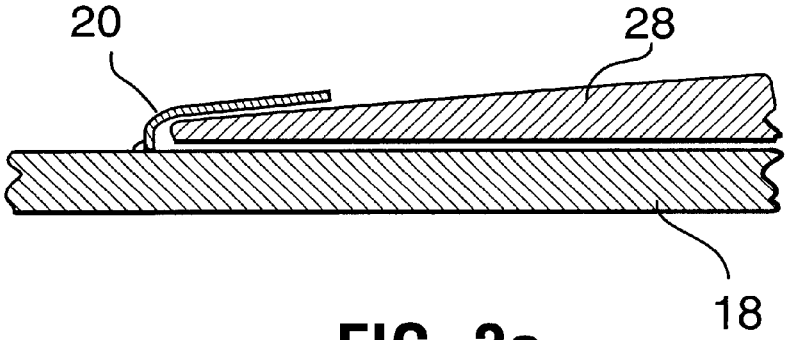
FIG. 3a
FIG. 3b
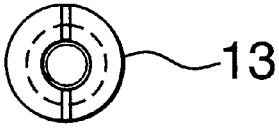
FIG. 3c
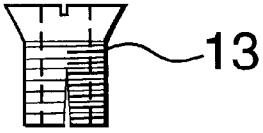

HAIR-CUTTING TOOL

BACKGROUND OF THE INVENTION

1. Field of the Invention

This invention relates to hair-cutting tools, and particularly to scissors, shears, or like instruments that are used to cut or thin hair, said scissors having multiple pairs of blades.

Currently, the standard technique for the blunt cutting, thinning, sculpting, or texturing of hair, or any other technique known for the removal or styling of hair by a hairdressing professional, is to use a pair of scissors incorporating a single pair of cutting blades. The cutting blades take the form of either straight or toothed/serrated cutting edges, and the scissors are manipulated horizontally in relation to the hair shaft.

The development of the present invention was necessitated by the limitations of the tools and techniques currently utilized within the hairdressing trade and the desire to achieve a certain degree of perfection within a craft. A disadvantage of the standard technique is that cutting hair horizontally leaves the ends of the hair shafts blunt and heavy rather than achieving a desired lightness through the ends that allows for more movement, a reduction of weight, and a resulting reduction in bulk. There are also certain styles that cannot be achieved without drastic hair volume reduction. A vertical orientation of the scissors offers one means of addressing this problem. This vertical technique, called point cutting, lightens, thins, softens, and textures the hair ends. However, a vertical approach with a traditional single-bladed pair of scissors is arduous and time-consuming.

In response to this problem, the present invention provides a multiple-bladed hair-cutting tool that will drastically reduce the time and effort entailed in the vertical cutting technique. The use of the present invention in a vertical orientation by a skilled hairdresser will allow for: softening of hair; thinning of hair without the hair marking that attends traditional thinning scissors; weight reduction on very short, thick hair by channeling without marking; making evenly spaced wisps; the possibility of sculpting straighter hair into waves with a freehand technique known to skilled hairdressers that creates more hair movement; the availability of more blade surface; and many other advantages over traditional tools and techniques.

Razors and thinning scissors have traditionally been used to simultaneously reduce hair weight, maintain length, and create movement. However, razors tear at the hair being cut, resulting in splitting of the hair and fraying of the hair ends, and they fail to provide the operator with adequate control over how much weight, volume, bulk, or mass is removed at a single stroke, nor do they provide enough control over the exactness of the varying lengths. Thinning shears also fail to provide an attractive and desirable result, as they bite the hair and mark it. The present invention provides an alternative means for thinning or cutting hair that addresses these problems by utilizing a plurality of cutting blades.

2. Description of the Background Art

Prior attempts to provide a multiple-bladed hair-cutting tool include U.S. Pat. No. 2,272,580, wherein is disclosed hair cutting and thinning shears which include two blade units incorporating an integrated plurality of cutting and thinning surfaces, each blade unit with a handle. However, these blade units do not operate in the same manner as the present invention with its multiple pairs of cutting blades, nor do they provide the option of removing the extra cutting blades to allow for operation as a traditional pair of scissors or for ease of sharpening. In U.S. Pat. No. 2,272,580, the two blade units are the only components and are equipped with a plurality of straight cutting edges and thinning blades with teeth, an entirely different approach to the problems of hair cutting and thinning than is utilized in the present invention. In addition, this prior art fails to address the problems associated with thinning scissors generally.

SUMMARY OF THE INVENTION

The principal object of this invention is, therefore, to provide a manually operable hair-cutting tool capable of being effectively utilized in a vertical hair-cutting technique, the tool comprising at least three pairs of cutting blades, with actuating means on an intermediate pair. Although some horizontal hair cutting may still be necessary, this new hair-cutting tool is to mainly be used vertically in relation to the hair being cut, or nearly parallel to the hair shaft itself, rather than the traditional horizontal cutting procedure, allowing for such effects as graduation and layering.

Other objects will appear from the description and the drawings.

Accordingly, the present invention provides a hair-cutting tool comprising at least three pairs of elongated cutting blades, said pairs separate from each other but provided with a means of being removably connected together at a pivot point and thereby forming a combination of a central pair of cutting blades and at least two outer pairs of cutting blades, such that the cutting blades operate together through movement of actuating handles on the central pair of cutting blades around the pivot point.

BRIEF DESCRIPTION OF THE DRAWINGS

In the drawings, according to the preferred embodiment of the invention:

FIG. 2*a* is a side view showing the fully-assembled hair-cutting tool in closed position, with alternative means for connecting the main components together;

FIG. 3*a* is an enlarged cross-sectional view taken on line 3*a*—3*a* of FIG. 1 of the fully-assembled hair-cutting tool;

FIG. 3*b* is a top view of a hollow bolt, one of which is inserted into each of the pairs of cutting blades to allow for passage of the main bolt connecting the main components together;

FIG. 3*c* is a side view of a hollow bolt, one of which is inserted into each of the pairs of cutting blades to allow for passage of the main bolt connecting the main components together;

DETAILED DESCRIPTION OF A PREFERRED EMBODIMENT

Figure 4:
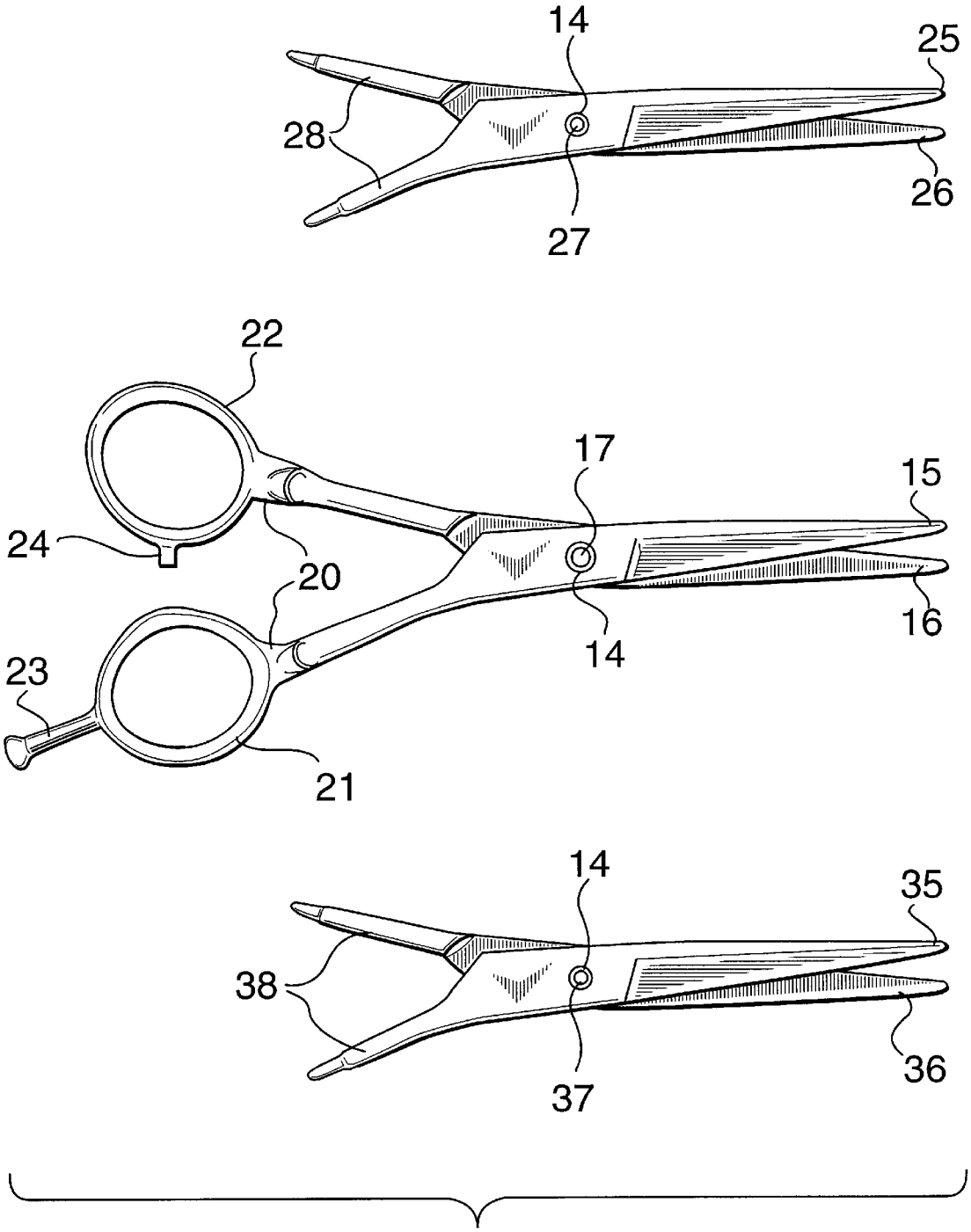
FIG. 4 is a plan view of the three main components of the hair-cutting tool in unassembled form.

Referring to the Figures, hair-cutting tool 10 is a preferred embodiment of the invention, comprising three main components. The three main components are a central pair of cutting blades 15, a first outer pair of cutting blades 25, and a second outer pair of cutting blades 35, as can be clearly seen in FIG. 4.

Figure 3:
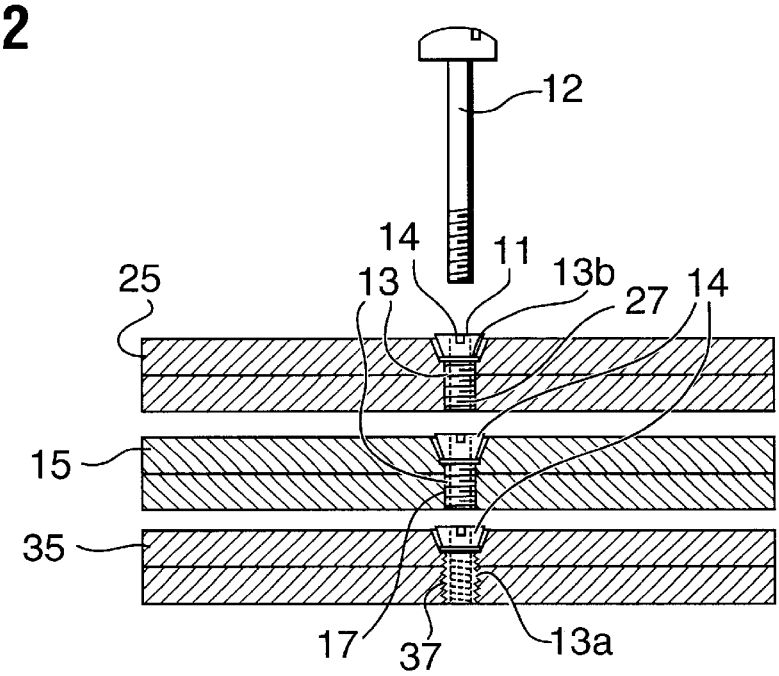
FIG. 3 is an enlarged cross-sectional view taken on line 3—3 of FIG. 1 of the fully-assembled hair-cutting tool.

The three main components of hair-cutting tool 10 are connected together pivotally at pivot point 11, with the axis of pivot point 11 being defined by bolt 12 which passes through the three main components. The means for passage of bolt 12 through the three main components is cylindrical holes 27 and 17 and threaded cylindrical hole 37. Cylindrical holes 27 and 17 and threaded cylindrical hole 37 are formed by the insertion of hollow bolts 13 and threaded hollow bolt 13*a* into holes which respectively pass through the first outer pair of cutting blades 25, the central pair of cutting blades 15, and the second outer pair of cutting blades 35 at pivot point 11. FIGS. 3*b* and 3*c* show a hollow bolt 13. Rubber washers 13*b* are seated in a countersink before hollow bolts 13 and threaded hollow bolt 13*a* are inserted. Once bolt 12 is passed through cylindrical holes 27 and 17, which have a smooth inner surface, and threaded into threaded cylindrical hole 37, bolt 12 provides the means for connecting the three main components together for simultaneous operation of all three pairs of cutting blades. Hollow bolt heads 14 serve to separate the three main components a distance required to enhance utility of the invention.

The central pair of cutting blades 15 is equipped with actuating handles 18 and 19 to allow for operation of hair-cutting tool 10. When hair-cutting tool 10 is fully assembled, these actuating handles 18 and 19 will serve to rotate the three main components around pivot point 11 between an open and a closed position. To further enhance the utility of the invention by ensuring exact simultaneity of movement between the three main components, actuating handles 18 and 19 of the central pair of cutting blades 15 are equipped with blind holes 20 on both sides of both actuating handles 18 and 19 to allow for attaching of handles 28 and 38 of the first outer pair of cutting blades 25 and the second outer pair of cutting blades 35, respectively, to actuating handles 18 and 19. Handles 28 and 38 are accordingly shorter than actuating handles 18 and 19 and the ends of handles 28 and 38 are shaped so as to engage with blind holes 20 and to be engaged in this manner during operation of hair-cutting tool 10. As can be seen in FIG. 3*a*, the ends of handles 28 and 38 do not fit snugly within blind holes 20, but rather there is a very minor amount of room allowing for limited movement of handles 28 and 38 within blind holes 20 to maintain parallel positioning of the three pairs of cutting blades during operation of hair-cutting tool 10.

To further enhance the utility of the invention, although not necessary to its utility, first actuating handle 18 of the central pair of cutting blades 15 can be provided with a finger hole 21 at the end of actuating handle 18 distant from pivot point 11. This finger hole 21 can further be optionally modified to incorporate finger projection 23 to enhance utility of hair-cutting tool 10 in a manner familiar to those skilled in the art, stabilizing hair-cutting tool 10 in its operation.

To further enhance the utility of the invention, although not necessary to its utility, second actuating handle 19 of the central pair of cutting blades 15 can be provided with a thumb hole 22 at the end of actuating handle 19 distant from pivot point 11. This thumb hole 22 can further be optionally modified to incorporate abutment 24 to enhance utility of hair-cutting tool 10 in a manner familiar to those skilled in the art.

Although beveling of the cutting blades is not necessary to the utility of the invention, the central pair of cutting blades 15 optionally incorporates blades with beveled cutting edges 16 to further enhance the utility of the invention. The first outer pair of cutting blades 25 and the second outer pair of cutting blades 35 similarly incorporate beveled cutting edges 26 and 36, respectively, to likewise enhance utility of the invention.

It is clear from the preceding and to any person skilled in the art that the three pairs of cutting blades 15, 25, and 35 need not be of equal lengths to serve the purposes of the invention. The first outer pair of cutting blades 25 and the second outer pair of cutting blades 35, for example, could be of shorter length than the central pair of cutting blades 15 to produce certain effects upon the hair being cut. It will also be clear from the preceding that the central pair of cutting blades 15 may optionally be used as a simple double-bladed pair of scissors without the first outer pair of cutting blades 25 and the second outer pair of cutting blades 35 being connected to it.

Figure 1:
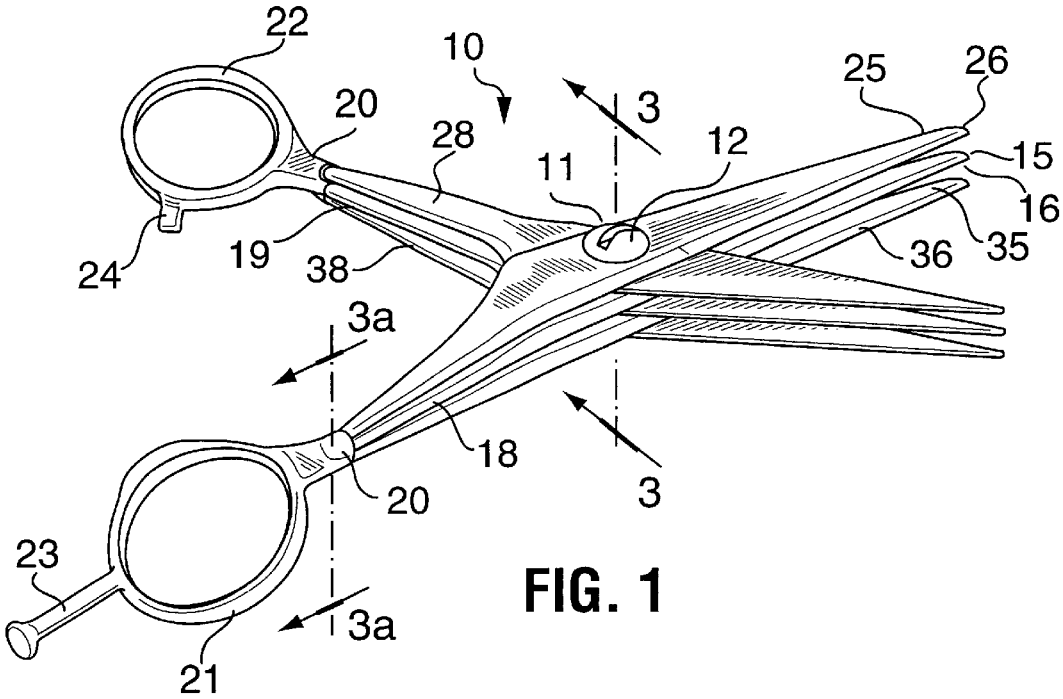
FIG. 1 is a perspective view of the fully-assembled hair-cutting tool in open position.
Figure 2:
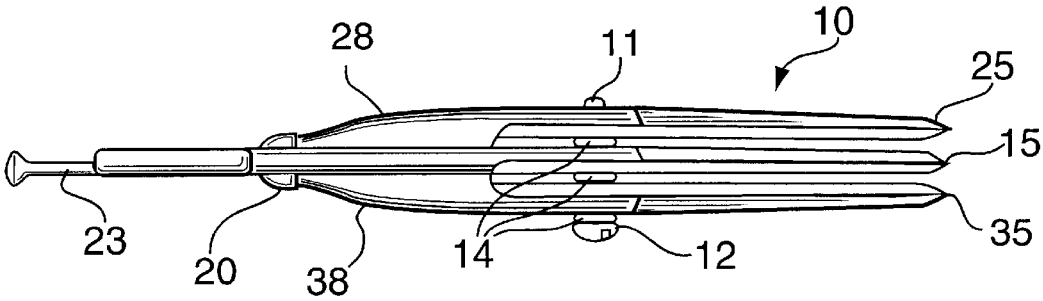
FIG. 2 is a side view showing the fully-assembled hair-cutting tool in closed position.

An alternative means of connecting the three main components together is shown in FIG. 2*a*. In this alternative embodiment, cylindrical holes 27 and 17 and threaded cylindrical hole 37 are not defined by hollow bolts 13 and threaded hollow bolt 13*a*, but they are simply holes through which bolt 12 passes. Spacers 14*a* act to separate the three main components, rather than hollow bolt heads 14, and bolt 12 is threaded into threaded cylindrical hole 37. A further alternative connecting means is shown in FIG. 2*a*, wherein handles 28 and 38 of the first outer pair of cutting blades 25 and the second outer pair of cutting blades 35, respectively, are connected to actuating handles 18 and 19 by means of screws 20*a*, rather than blind holes 20.

Having assembled the three main components, the present invention is manually operated preferably by means of placing the third finger of the operator's hand (not shown) in finger hole 21, the fourth finger of the same hand (not shown) against the side of finger projection 23 for stability of operation, and the thumb of the same hand (not shown) in thumb hole 22. Hair-cutting tool 10 can then be manipulated by rotating actuating handles 18 and 19 about pivot point 11, paired cutting blades 15, 25, and 35 thereby being moved between an open and a closed position in order to cut the section of hair (not shown) situated between the two cutting blades of each set of paired cutting blades. Hair-cutting tool 10 is preferably held in a near-vertical position, nearly parallel to the hair shaft, to achieve the desired hair-cutting results.

It will be clear to any person skilled in the art that other means of connecting the three main components together are available and would serve the same function, as would other means of providing spacing between the three main components, without departing from the spirit of the invention. As is clear from the preceding, further modifications of and adjustments to this invention, not shown, are possible without departing from the spirit of the invention as demonstrated through this preferred embodiment.

What is claimed is:

1. A hair-cutting tool comprising at least three pairs of elongated cutting blades, said pairs separate from each other but provided with a means of being removably connected together at a pivot point and thereby forming a combination of a central pair of cutting blades and at least two outer pairs of cutting blades, such that the cutting blades operate together through movement of actuating handles on the central pair of cutting blades around the pivot point;

each of the at least three pairs of cutting blades being equipped with a hole defined by means of a hollow bolt forming a hollow cylinder, said pairs of cutting blades connected by means of a single bolt with a threaded end passing through the hollow cylinder in each of the pairs of cutting blades and threadedly engaging the hole in a selected outer pair of cutting blades, with the single bolt defining the pivot point and heads of the hollow bolts acting as spacers between the pairs of cutting blades;

handles of the outer pairs of cutting blades being connected to the actuating handles of the central pair of cutting blades by connecting means on both sides of both actuating handles of the central pair of cutting blades to provide limited movement of the handles of the outer pairs with respect to the actuating handles while maintaining parallel positioning of the outer and the central cutting blades during use;

and only the actuating handles on the central pair of cutting blades being connected respectively to a finger hole and a thumb hole.

2. A hair-cutting tool comprising at least three pairs of elongated cutting blades, said pairs separate from each other but provided with a means of being removably connected together at a pivot point and thereby forming a combination of a central pair of cutting blades and at least two outer pairs of cutting blades, such that the cutting blades operate together through movement of actuating handles on the central pair of cutting blades around the pivot point;

each of the at least three pairs of cutting blades is equipped with a hole defined by means of a hollow bolt forming a hollow cylinder, said pairs of cutting blades connected by means of a single bolt with a threaded end passing through the hollow cylinder in each of the pairs of cutting blades, and threadedly engaging the hole in a selected outer pair of cutting blades, with the single bolt defining the pivot point and heads of the hollow bolts acting as spacers between the pairs of cutting blades;

handles of the outer pairs of cutting blades are connected to the actuating handles of the central pair of cutting blades through blind holes on both sides of both actuating handles of the central pair of cutting blades within which the ends of the handles of the outer pairs of cutting blades are positioned to provide limited movement of the handles of the outer pairs with respect to the actuating handles while maintaining parallel positioning of the outer and the central cutting blades during use.

3. A hair-cutting tool comprising at least three pairs of elongated cutting blades, said pairs separate from each other but provided with a means of being removably connected together at a pivot point and thereby forming a combination of a central pair of cutting blades and at least two outer pairs of cutting blades, such that the cutting blades operate together through movement of actuating handles on the central pair of cutting blades around the pivot point;

each of the at least three pairs of cutting blades is equipped with a hole defined by means of a hollow bolt forming a hollow cylinder, said pairs of cutting blades connected by means of a single bolt with a threaded end passing through the hollow cylinder in each of the pairs of cutting blades, and threadedly engaging the hole in a selected outer pair of cutting blades, with the single bolt defining the pivot point and heads of the hollow bolts acting as spacers between the pairs of cutting blades;

handles of the outer pairs of cutting blades are connected to the actuating handles of the central pair of cutting blades by means of screws on both sides of both actuating handles of the central pair of cutting blades to provide limited movement of the handles of the outer pairs with respect to the actuating handles while maintaining parallel positioning of the outer and the central cutting glades during use.

* * * * *